US005333867A

United States Patent [19]

DiVito

[11] Patent Number: 5,333,867

[45] Date of Patent: Aug. 2, 1994

[54] BALL-DRIVING DEVICE

[76] Inventor: Anthony J. DiVito, 4932 Farrington Dr., Virginia Beach, Va. 23455

[21] Appl. No.: 155,626

[22] Filed: Nov. 22, 1993

[51] Int. Cl.[5] ..... A63B 71/00

[52] U.S. Cl. ..... 273/129 M; 124/79

[58] Field of Search ..... 273/67 R, 126 R, 118 R, 273/119 R, 128 R, 128 A, 129 R, 129 M; 124/79; 446/450, 451, 452, 453

[56] References Cited

U.S. PATENT DOCUMENTS

| | | | |
|---|---|---|---|
| 1,891,130 | 12/1932 | Wilson | 273/129 L |
| 2,263,602 | 11/1941 | Whittle | 273/129 M X |
| 2,433,496 | 12/1947 | Von Pein | 273/129 M |
| 2,717,780 | 9/1955 | Mantz | 273/129 L |
| 3,220,730 | 11/1965 | Fine | 273/129 M X |
| 3,228,693 | 1/1966 | Ingebo | 273/129 M |
| 4,185,827 | 1/1980 | Allen | 273/129 L |
| 4,252,318 | 2/1981 | Thibodeau | 273/129 L |

OTHER PUBLICATIONS

The Sporting Goods Dealer "Shuffleboard Sets With Cushion Discs" Nov. 1956 vol. 115, No. 2 p. 202.

*Primary Examiner*—William H. Grieb

*Attorney, Agent, or Firm*—Walter F. Wessendorf, Jr.

[57] ABSTRACT

A ball-driving device has an elongated handle in adjustable and lockable relative relationship with a chassis mounting one wheel inboard of the chassis, and, in a modification thereof, two wheels outboard of the chassis for greater stability. The distal portion of the chassis has Y-branched arms for cradling a ball to be driven over and upon a playing surface and a drive cup that makes physical contact with the ball to be driven upon forward driving thrust of the handle.

6 Claims, 2 Drawing Sheets

BALL-DRIVING DEVICE

BACKGROUND

1. Technical Field

This invention relates to a ball-driving device for use in an outdoors recreational game, such as "BOCCIE", for driving a ball with greater accuracy over and upon a even or uneven playing surface.

2. Background

"BOCCIE" is a several-centuries-old Italian outdoors recreational game whose playing surface was rough or uneven because none other was available and was played by two opposing teams. As it has evolved, the game has opposing teams of two to four players each, played with $4\frac{1}{2}''$ diameter balls on a $10' \times 60'$ dirt court. Each team has its own color balls, except white. The game is started by a team player tossing out a smaller white ball upon the playing surface, referred to as a jack or target ball. Players, in succession and alternating between the teams, throw their respective balls with the object of getting closest to the target ball. One point is awarded to a team for each of its ball(s) that is(are) closer to the target ball than its opponents'. To further accomplish this, the players on a team may throw their balls to contact and move an opposing team's ball or balls away from the target ball, or to contact and move the target ball away from such opposing team's ball or balls. The first team, scoring 12 points, wins the game. Historically, it is deemed that all other similar outdoors recreational ball games evolved from "BOCCIE". The Unione Federazioni Italiane Bocce, located in Genoa, Italy, is the governing organization for "BOCCIE".

SUMMARY OF THE INVENTION

Accordingly, the object of the invention is to provide a ball-driving device by which not only members of opposing teams can compete in playing "BOCCIE" and other similar outdoors recreational ball games. Since the ball-driving device of this invention allows the ball to be easily driven with greater accuracy over and upon an even or uneven playing surface of dirt, grass, sand or artificial turf, this invention opens the door to allow the game to also be played and enjoyed, regardless of gender, by the young, the old, the disabled and even those confined to wheel chairs, who were formerly inactive spectators. In other words, the former inactive spectators can become active participants.

BRIEF DESCRIPTION OF THE DRAWINGS

This object, and other objects, of the invention should be discerned and appreciated by reference to the detailed description of the preferred embodiment taken in conjunction with the drawings, wherein like reference numerals refer to similar elements throughout the several views, in which.

DETAILED DESCRIPTION OF THE PREFERRED EMBODIMENT

Figures 1, 3:
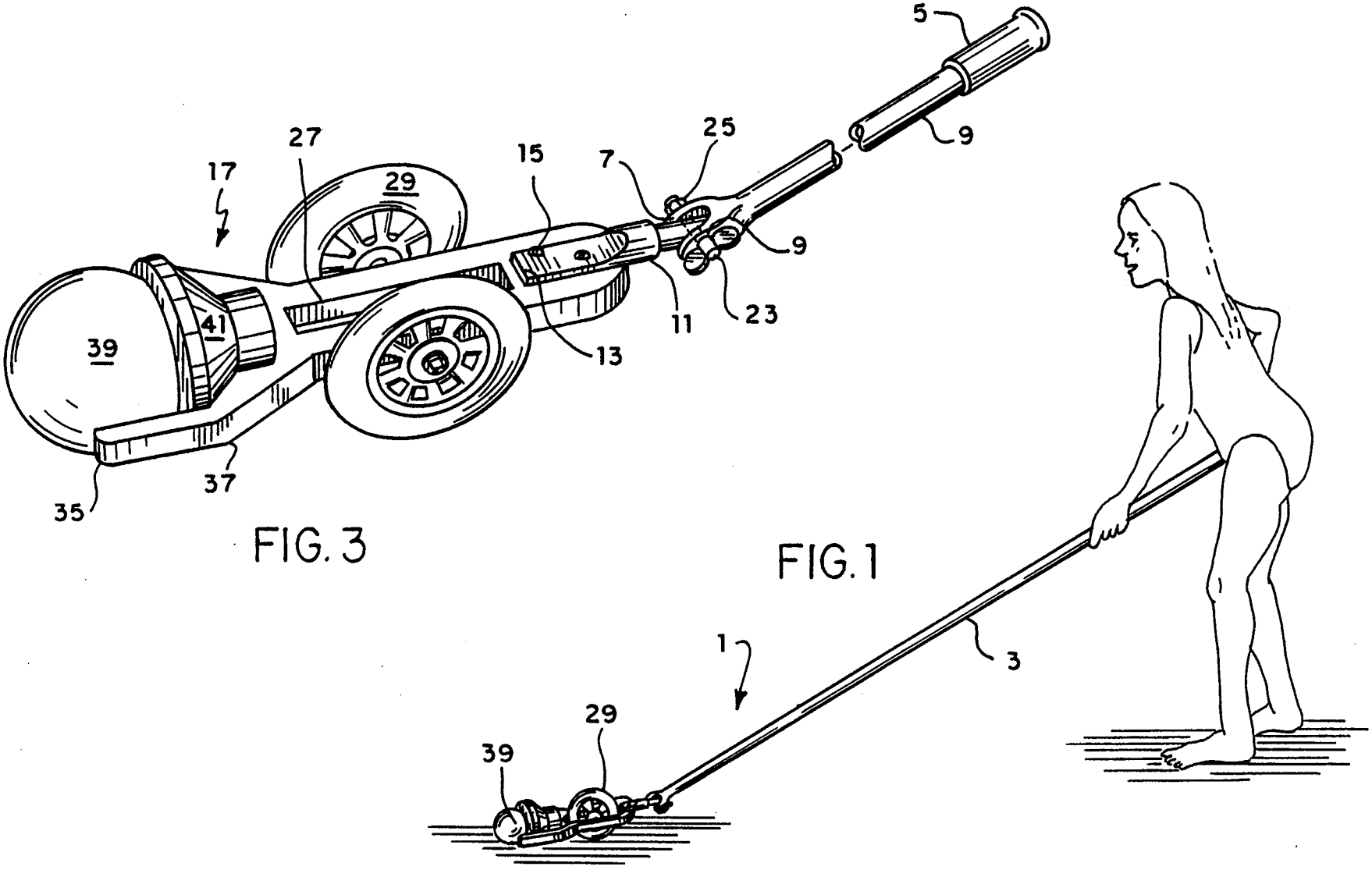
FIG. 1 is a perspective view, showing a young lady grasping the device preparatory to her driving a ball.
FIG. 3 is an enlarged perspective view of the device showing wheels mounted laterally outboard of the chassis.

In FIG. 1 of the drawings, reference numeral 1 generally refers to the invention.

The device 1 has an elongated handle 3 whose proximal end has a grip 5 and whose distal end defines bifurcated arms 7, having aligned transverse holes therethrough. A bracket 11 has a distal end 13 fixedly mounted by screws 15 to the proximal end of a chassis 17. Bracket 11 has a proximal end 19 having a transverse hole 21 therethrough. A wing bolt 23, whose shank is disposed through the aligned holes 9 and 21, carries on its threaded end a nut 25, thereby providing a lockable and adjustable clevis-mounting feature for the connection of the distal end 7 of the handle 3 with the proximal end 19 of the bracket 11.

Figure 2:
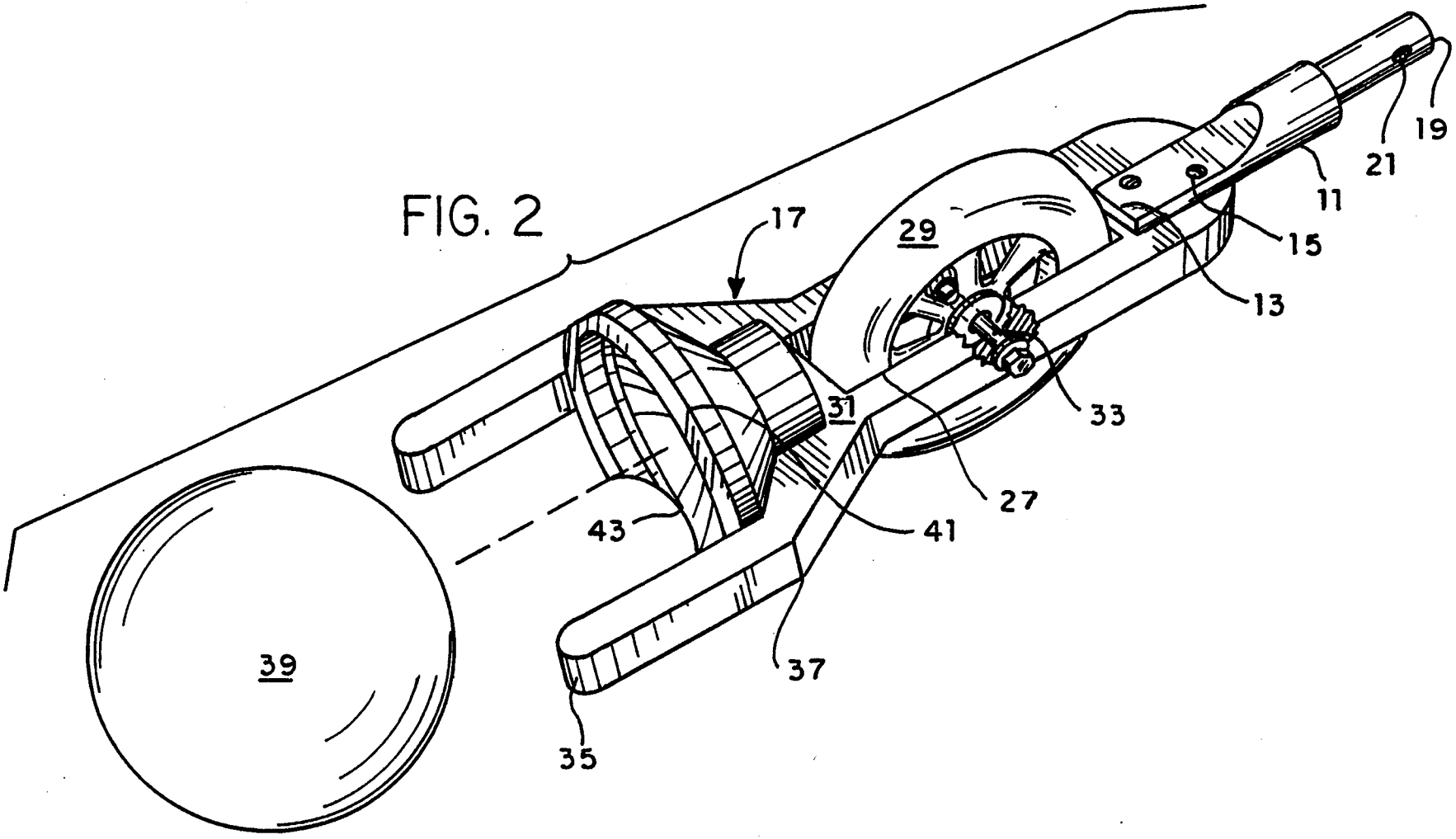
FIG. 2 is an enlarged fragmentary perspective view of the device in which a single wheel is mounted inboard of the chassis.

As shown in FIG. 2, chassis 17 has an elongated slot 27 therethrough which freely receives inboard therein a wheel 29. The lateral sides 31 of the chassis 17 carry a transversely disposed axle 33 to freely mount the wheel 29.

The distal end 35 of the chassis 17 defines a Y-branched end whose opposed arms 37 function to cradle a playing ball 39 preparatory to its being driven. A drive cup 41 has complemental mating surfaces in common with the distal end 35 by which drive cup 41 is adhesively fixed thereto. A segment 43 is removed from the bottom of the drive cup 41 to spatially provide ground clearance for the cup 43 in the forward thrust of the cup 43 in its contacting and driving the ball 39; and, to prevent the drive cup 41 from being obstructed in its forward driving movement by its physical contact, otherwise, with an immediate proximate obstruction, such as a clump of grass on the playing surface.

FIG. 3 differs structurally and functionally from FIG. 2 in that two wheels 29 are axle-mounted outboard of the chassis 17 to afford and provide thereby greater stability for the device and accuracy in driving a ball 39 over and upon a playing surface.

Preparatory to his or her thrusting the handle forwardly to have the drive cup 41 make physical contact with the ball and thereby drive it forwardly upon and over the playing surface, a player would line up the handle 3 to coincide with the intended direction of forward movement of the ball 39, for purposes of greater drive accuracy.

The adjustable and lockable clevis-mounting feature, as described, easily allows the drive cup 41 to be elevated or depressed relative to the playing surface, depending upon whether the immediate lie of the ball 39 is, correspondingly, on an upgrade or a downgrade. To effect such relative positioning of the handle 3 and chassis 17, the nut 25 is sufficiently loosened, the handle 3 is either elevated or depressed relative to the chassis 17 and the wing bolt 23 is sufficiently tightened.

I claim:

1. A ball-driving device for driving a ball over and upon a playing surface, said ball-driving device comprising: an elongated handle having a proximal end and a distal end, a bracket having a proximal end and a distal end, a chassis having a proximal end, an elongated slot therethrough, and a distal end; the proximal end of the chassis fixedly carrying the distal end of the bracket, the distal end of the handle and the proximal end of the bracket having cooperating means both connecting the handle and bracket, and providing adjustable and lockable clevis mounting of the handle relative to the chassis, the chassis having axle means freely mounting wheel means for rolling movement of the device upon the playing surface, the distal end of the chassis being Y-branched for cradling the ball preparatory to the ball being driven forwardly, and the distal end of the chassis fixedly carrying a drive cup for physically contacting the cradled ball upon forward thrust of the handle to drive the ball forwardly upon and over the playing surface.

2. A ball-driving device in accordance with claim 1, wherein the wheel means is a single wheel freely mounted inboard within the elongated slot of the chassis.

3. A ball-driving device in accordance with claim 1, wherein the wheel means are two wheels, each freely mounted outboard of the chassis.

4. A ball-driving device in accordance with claim 1, wherein the drive cup has a segment removed from its bottom to spatially provide physical ground clearance from an obstruction encountered by the drive cup in its forward driving movement.

5. A ball-driving device in accordance with claim 2, wherein the drive cup has a segment removed from its bottom to spatially provide physical ground clearance from an obstruction encountered by the drive cup in its forward driving movement.

6. A ball-driving device in accordance with claim 3, wherein the drive cup has a segment removed from its bottom to spatially provide physical ground clearance from an obstruction encountered by the drive cup in its forward driving movement.

* * * * *